US005870932A

United States Patent [19]

Brooke

[11] Patent Number: 5,870,932

[45] Date of Patent: Feb. 16, 1999

[54] SWIFT WRENCH

[76] Inventor: Karlton W. Brooke, P.O. Box 31, Texarkana, Ark. 75504-0031

[21] Appl. No.: 778,445

[22] Filed: Oct. 1, 1996

[51] Int. Cl.[6] ..... B25B 13/16

[52] U.S. Cl. ..... 81/177.8; 81/177.9

[58] Field of Search ..... 81/177.8, 177.9

[56] References Cited

U.S. PATENT DOCUMENTS

| | | | |
|---|---|---|---|
| 174,745 | 3/1876 | Squire | 81/177.8 X |
| 1,379,536 | 5/1921 | Davies | 81/177.8 X |
| 1,384,887 | 7/1921 | Burndahl | 81/177.8 |
| 1,568,442 | 1/1926 | Carver | 81/177.8 |
| 1,840,685 | 1/1932 | Witherup | 81/177.8 |
| 2,804,794 | 9/1957 | Stang | 81/177.8 |
| 5,694,818 | 12/1997 | Nickipuck | 81/177.8 X |

*Primary Examiner*—James G. Smith

[57] ABSTRACT

A wrench having a head (1) with an angularly adjustable handle (2) that can be locked in a plurality positions by a sliding rod (4) activated by a trigger (3). The rod (4) is engagable in holes (5 and 8) in the head (1) to lock the handle in the desired position. A spring (7) biases the rod (4) into a locking position.

2 Claims, 2 Drawing Sheets

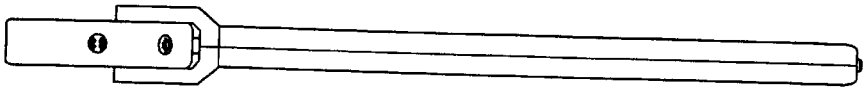
Fig. 4
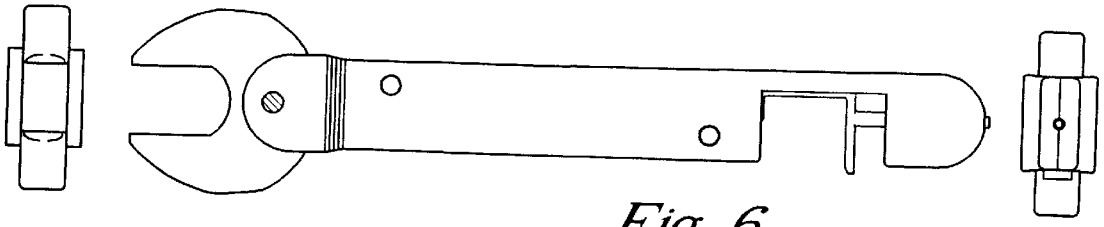
Fig. 5
Fig. 6
Fig. 7
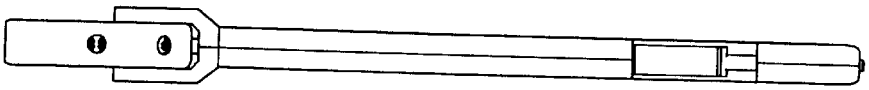
Fig. 8
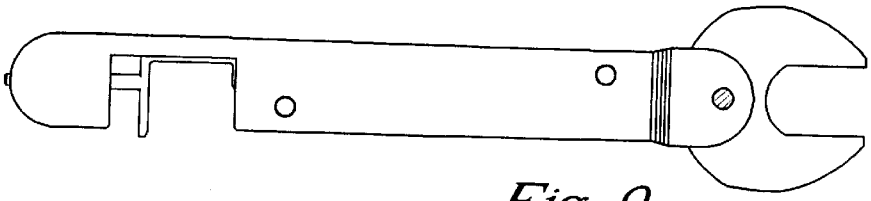
Fig. 9

SWIFT WRENCH

BACKGROUND OF THE INVENTION

This invention is generally related to wrenches of the type having a pivotally attached handle that is lockable in various positions with respect to the wrench head.

SUMMARY OF THE INVENTION

The present invention is to a wrench head having a handle that is positionable at various angles with respect to the wrench head. The handle is then lockable in the desired position by means of a rod slidable in the handle which engages in openings spaced on the head. the rod is actuated by way of a trigger mounted in a finger hole on the handle.

BRIEF DESCRIPTION OF THE DRAWINGS

FIG. 4 shows a plan view of the top surface of the wrench.

FIG. 5 shows a front elevation view of the wrench head attached to the handle.

FIG. 6 shows a side elevation view of the wrench.

FIG. 7 shows a rear elevation view of the wrench handle attached to the wrench held.

FIG. 8 shows a reverse plan view of the bottom surface of the wrench.

FIG. 9 shows the opposite side of FIG. 6.

DETAILED DESCRIPTION OF THE PREFERRED EMBODIMENT

Figure 1:
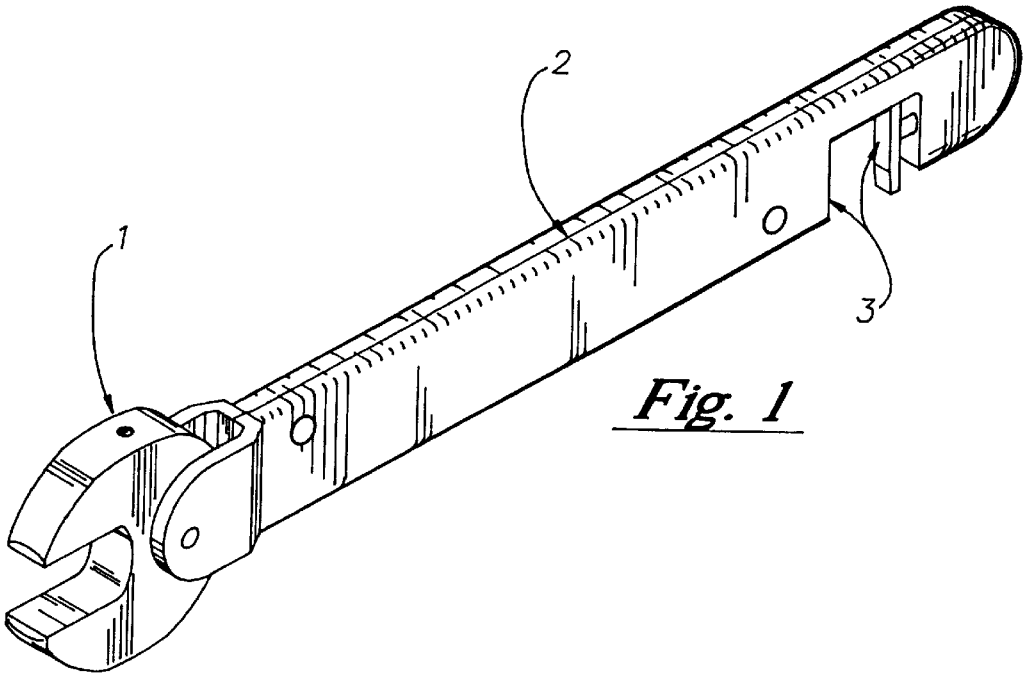
FIG. 1 shows the wrench in perspective view.
Figure 2:
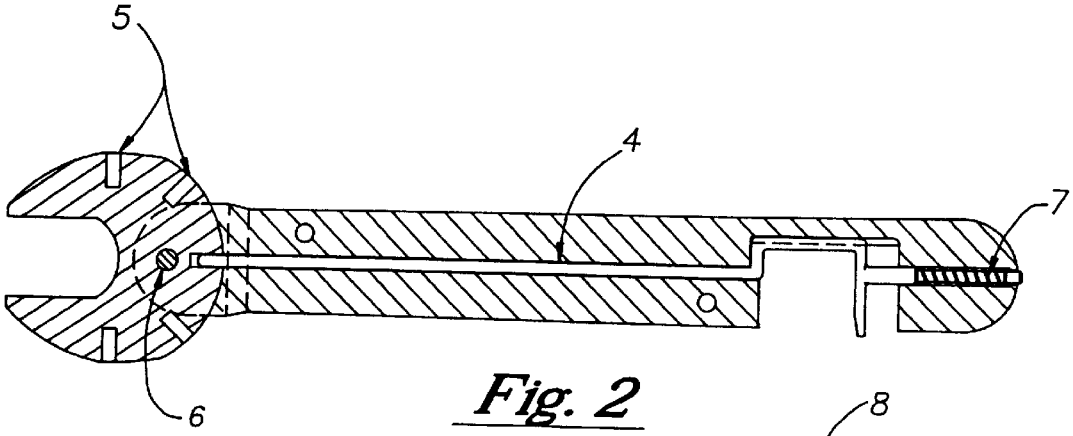
FIG. 2 shows an open face view exposing the inner working parts from a side angle.
Figure 3:
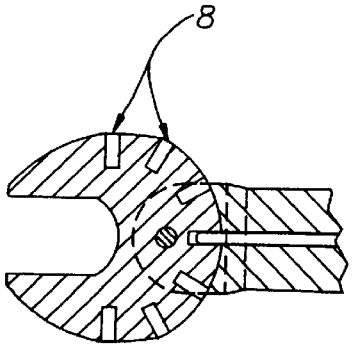
FIG. 3 shows the wrench head detail for the larger wrench head sizes.

The drawings represent the preferred embodiment of the present invention designated generally as an open end adjustable head wrench to change the angle of the handle 2 with respect to the head 1 of the wrench.

As illustrated in the drawings, a spring 7 and trigger 3 are connected to a rod 4 that connects to the head 1. The angle at which the handle 2 joins the head 1 is variable.

The spring 7 is located in the end of the wrench connected to the rod 4 that runs the length of the handle 2. The trigger 3 is formed by the rod 4 being squared over a finger hole in the handle.

The head 1 of the wrench is Connected to the handle 2 by a rivet 6. The rivet 6 pivots to allow easy relative movement of the head 1 and handle 2. The head 1 is designed for use on bolts, nuts or screws, etc. of different sizes. Holes 5 and 8 are provided in the head 1 to receive the rod 4.

The handle 2 of the wrench is made in two parts held together by two screws. The handle 2 is rounded for comfortable gripping and is grooved inside to allow for the rod 4.

When the trigger 3 is activated by the user, it pulls on the rod 4 which moves the rod 4 rearward in the handle 2 and out of engagement with a hole 5 or 8. The handle 2 is then angularly repositioned at the desired angle with respect to the head 1. The range of movement of the handle is up to 90° from the position shown in FIG. 1 in either a clockwise or counterclockwise direction.

The tensile strength of the wrench will effect the torque that can be applied. The torque capability will be in the material hardness and method of manufacture.

In this invention, the trigger 3 can be moved by the user without the wrench being removed front the nut, bolt or screw, etc. In prior tools, some are awkward to use wile other need tools or both hands to change the angle of the head and handle. Other wrenches have numerous parts associated with them causing more production costs and possibly more breakage of parts. This invention is a simple tool and has few parts causing less production costs and less breakage.

The object of this design is that the wrench would be essential to mechanics working on motors in tight places, especially transmissions.

I claim:

1. An adjustable head wrench comprising:

a head having a set of jaws to grip a workpiece on one end and a series of holes on an other end;

a handle having a bifurcated end and an opposite end;

said handle bifurcated end attachable to said head at a point between said jaws and said holes to allow for pivotal movement of said handle with respect to said head;

an elongated opening extending along a longitudinal axis of said handle from said bifurcated end to said opposite end and a rod slidably secured within said opening;

said rod having a first end extending into said bifurcated end of said handle and into said holes of said head to lock said handle into any one of a variety of positions with respect to said head;

said handle further having a slot extending from a side of said handle and bisecting said opening thus defining a U-shape;

said rod having a trigger portion within said slot and front and rear portions that fit into said opening, said front portion including said first end and a return spring within said opening and surrounding said rear portion of said rod;

whereby upon actuation of said trigger portion to slide said rod along said handle, said first end being moved out of engagement with one of said holes to allow said handle to be repositioned along said head and when said trigger portion is released, said spring slides said rod first end into another of said holes to lock said handle in a different position with respect to said head.

2. An adjustable wrench according to claim 1, wherein said handle is made in two identical sections with a portion of said opening being in each half, and fasteners to secure said sections together.

* * * * *